US010462564B2

(12) United States Patent
Fan et al.

(10) Patent No.: US 10,462,564 B2
(45) Date of Patent: Oct. 29, 2019

(54) OPERATING A HEADSET THAT INCLUDES MICROPHONE LINE AND PUSHBUTTON KEYS

(71) Applicant: TEXAS INSTRUMENTS INCORPORATED, Dallas, TX (US)

(72) Inventors: Ball Fan, Tianjin (CN); Wenpang David Wang, Allen, TX (US); Christopher Michael Graves, Sherman, TX (US)

(73) Assignee: Texas Instruments Incorporated, Dallas, TX (US)

( * ) Notice: Subject to any disclaimer, the term of this patent is extended or adjusted under 35 U.S.C. 154(b) by 166 days.

(21) Appl. No.: 15/277,579

(22) Filed: Sep. 27, 2016

(65) Prior Publication Data

US 2017/0019733 A1 Jan. 19, 2017

Related U.S. Application Data

(62) Division of application No. 13/787,185, filed on Mar. 6, 2013, now Pat. No. 9,479,882.

(51) Int. Cl.

| | |
|---|---|
| ***H04R 3/00*** | (2006.01) |
| ***H04R 29/00*** | (2006.01) |
| ***H04R 1/10*** | (2006.01) |

(52) U.S. Cl.

CPC ..... *H04R 3/007* (2013.01); *H04R 1/1041* (2013.01); *H04R 29/00* (2013.01)

(58) Field of Classification Search

CPC ..... H04R 19/04; H04R 1/1041; H04R 5/033; H04R 29/00; H04R 3/00

USPC ..... 381/74

See application file for complete search history.

(56) References Cited

U.S. PATENT DOCUMENTS

| | | | | |
|---|---|---|---|---|
| 5,874,847 | A | 2/1999 | Kim et al. | |
| 6,246,272 | B1 | 6/2001 | Takai | |
| 6,408,020 | B1 | 6/2002 | Kaji et al. | |
| 8,290,171 | B1 | 10/2012 | Helfrich et al. | |
| 2004/0160993 | A1* | 8/2004 | Ganton | H04J 7/00 370/537 |
| 2012/0014530 | A1* | 1/2012 | Yamkovoy | H04M 1/6066 381/58 |
| 2014/0029770 | A1* | 1/2014 | Chien | H04R 3/00 381/123 |

* cited by examiner

*Primary Examiner* — Rasha S Al Aubaidi
*Assistant Examiner* — Jirapon Intavong
(74) *Attorney, Agent, or Firm* — Lawrence J. Bassuk; Charles A. Brill; Frank D. Cimino

(57) ABSTRACT

An audio accessory key detection system (40) includes a host circuit (2-3) coupled to communicate via a microphone line (7) with an accessory circuit (3-3) in either a MSFT mode or a digital communication mode. Depletion mode transistors (44-1,2,3) in the accessory circuit are coupled between keys (15-1,2,3) of the accessory circuit, respectively. The depletion mode transistors are allowed to remain conductive for MSFT mode operation. For digital communications mode operation, the host circuit sends a command via the microphone line to a key detector and controller circuit (29A) in the accessory circuit. In response, a voltage is generated to turn the depletion mode transistors off so as to allow digital communications mode operation between the accessory circuit and the host circuit.

9 Claims, 4 Drawing Sheets

OPERATING A HEADSET THAT INCLUDES MICROPHONE LINE AND PUSHBUTTON KEYS

This Application is a divisional of prior application Ser. No. 13/787,185, filed Mar. 6, 2013, now U.S. Pat. No. 9,479,882, issued Oct. 25, 2016.

BACKGROUND OF THE INVENTION

The present invention relates generally to audio accessory circuitry, such as circuitry for detecting actuation of pushbutton keys on a headset connected to a smart phone or the like. More particularly, the invention relates to accessory key detection circuitry that is capable of functioning in either the conventional analog "MSFT mode" or the conventional "digital communication mode.

Every headset used for mobile smart phone communication has a headset which has a microphone. The headsets for some mobile phones have a single pushbutton key, and other headsets may have 3 (or more) pushbutton keys. A typical headset has a microphone and 3 keys. When a headset key is depressed it sends a signal along a microphone conductor/line to the mobile phone. The mobile phone then recognizes that signal and performs a process or function corresponding to the depressed key, such as responding to the phone call, adjusting the audio volume, or muting the sound.

FIG. 1 shows a block diagram illustrating a conventional audio accessory key detection system which is capable of providing only conventional analog MSFT ("MicroSoft") mode communication between (for example) a "host" such as a smart phone and an accessory such as a headset connected to the smart phone. The MSFT mode is a mode that is specified by various manufacturers (including Motorola, Nokia, HTC, and Samsung) in which accessory key detection circuitry contained in a headset detects/decodes actuation of 1 to 3 pushbutton headset keys that may be actuated to control functions such as audio volume control and audio muting. Corresponding circuitry in the smart phone receives a signal generated in the headset by actuation of a key and operates on that signal to perform the function corresponding to the depressed key.

In FIG. 1, audio accessory key detection system 1 includes a host circuit 2-1 and an accessory circuit 3-1. Host circuit 2-1 includes a microphone bias circuit 5 coupled by a conductor 6 and a resistor R1 to a microphone line/conductor 7. Resistor R1 may have a resistance of 2 kilohms. Host circuit 2-1 also includes an ADC (analog to digital converter) 9 having its input coupled to microphone line 7 and its output coupled by a digital bus 10 to a host controller 11. Accessory circuit 3-1 includes microphone and bias circuitry 13, which includes a microphone 13A and a bias circuit 13B coupled to microphone line 7. Microphone 13A and bias circuit 13B are connected in parallel between microphone line 7 and ground, and bias circuit 13B provides a bias voltage to microphone 13A. Accessory circuit 3-1 also includes three pushbutton keys or switches 15-1, 15-2, and 15-3. Switch 15-1 (i.e., "Key 1") is connected between microphone line 7 and ground. Switch 15-2 ("Key 2") is coupled between microphone line 7 and one terminal of a resistor R2 (which may have a resistance of 220 ohms) and one terminal of a resistor R3 (which may have a resistance of 390 ohms). A second terminal of resistor R2 is connected to ground. Switch 15-3 ("Key 3") is coupled between microphone line 7 and the other terminal of resistor R3. If a user presses one of the keys of the accessory, a corresponding signal is transmitted by its accessory circuit 3-1 to host circuit 2-1, and host circuit 2-1 detects the transmitted signal and determines its meaning. (By way of definition, the term "depress" as used herein means "to press down on", and the terms "press" and "depress" are used herein interchangeably to refer to pressing or depressing of a button or actuating of a pushbutton switch.)

Microphone bias circuit 5 typically includes a low noise LDO (low dropout voltage regulator) that establishes a low noise bias voltage on conductor 6. If Key 1 is depressed, the voltage on microphone line 7 is grounded. The bias voltage on conductor 6 is resistively divided by resistors R1 and R2 to generate a higher voltage on microphone line 7 if Key 2 of the headset is depressed. The bias voltage on conductor 6 is divided by means of resistors R1, R2, and R3 to generate an even higher voltage on microphone line 7 if Key 3 is depressed. Microphone bias circuit 5 may also include a low pass filter. The voltage generated on microphone line 7 by depressing one of keys 15-1, 15-2, or 15-3 is converted to a digital form by ADC 9, and host controller 11 determines from the resulting digital information on bus 10 which of the keys was depressed or released. ADC 9 and host controller 11 function together to discriminate between the three voltages that may be generated on microphone line 7, identify which of the three keys has just been either depressed or released, and cause the host to perform the desired operation.

FIG. 2 is a block diagram illustrating a known host and accessory system 20 which is capable of providing conventional digital communication (but not MSFT mode communication) between the host and its accessory headset. In FIG. 2, audio accessory key detection system 20 includes a host circuit 2-2 which includes a microphone bias circuit 5 coupled by a conductor 6 and resistor R1 to microphone line 7. Resistor R1 may have a resistance of 2 kilohms. Host circuit 2-2 also includes a host transceiver 21 having its input coupled to microphone line 7 and its output coupled by digital DATA_OUT bus 26 to an output of host controller 11. A DATA_IN bus 23 is coupled between an output of host transceiver 21 and a data input of host controller 11. In this example, host transceiver 21 includes a N-channel MOS transistor 25 having its source connected to ground, its gate connected to DATA_OUT bus 26, and its drain connected by microphone line 7 to the input of a buffer circuit 22 having its output connected to DATA_IN bus 23.

Audio accessory key detection system 20 also includes an accessory circuit 3-2 including microphone and bias circuitry 13 and N pushbutton keys or switches 15-1 ("Key 1"), 15-2 ("Key 2"), 15-3 ("Key 3"), 15-4, . . . 15-N. As in Prior Art FIG. 1, microphone and bias circuit 13 includes a microphone 13A and bias circuit 13B. Microphone 13A and bias circuit 13B are connected in parallel between microphone line 7 and ground, and bias circuit 13B provides a bias voltage to microphone 13A. Each of switches 15-1, 15-2, . . . 15-N is coupled between ground and a key detector and controller circuit 29. Key detector and controller circuit 29 is powered by a voltage supply signal VDD generated by an energy storage circuit 28, which may include a charge storage capacitor or a rechargeable battery. Energy storage circuit 28 in accessory circuit 3-2 is coupled between microphone line 7 and a reference voltage such as ground. Energy storage circuit 28 generates a supply voltage VDD on conductor 30, which provides operating power to key detector and controller 29. Key detector and controller circuit 29 generates a serial digital output signal DATA_OUT on serial data bus 36, which is connected to the gate of a N-channel MOS transistor 35 in accessory transceiver 31. The source of transistor 35 is connected to ground.

The drain of transistor 35 is connected by microphone line 7 to the input of a buffer circuit 32 of accessory transceiver circuit 31. The output of buffer 22 produces a serial digital signal DATA_IN on serial data bus 33. DATA_IN bus 33 is connected to an input of key detector and controller circuit 29.

Energy storage circuit 28 may include a storage capacitor $C_{STORAGE}$ and a resistor connected in series between microphone line 7 and ground. VDD conductor 30 is connected to the junction between the resistor and one terminal of $C_{STORAGE}$, the other terminal of which is connected to ground. All of the energy required by accessory circuit 3-2 must be initially supplied to the storage capacitor by microphone bias circuit 5 of host circuit 2-2. Consequently, when there is data in the form of sequential "1"s and/or "0" being transmitted on microphone line 7, its voltage must be maintained at a high level (e.g., i.e., at approximately 2 volts) by microphone bias circuit 5 to ensure that energy storage circuit 28 remains adequately charged.

Key detector and controller circuit 29 requires very little current and power, and during data transmission energy storage circuit 28 may store added energy to power the integrated circuit chip in which host and accessory system 20 of FIG. 2 is fabricated. The energy is added because during data transmission the voltage on microphone line 7 successively switches between various "1" and "0" logic levels. The storage capacitor will be recharged during transmission of each "1" logic level, but not during transmission of "0" levels. Consequently, energy storage circuit 28 must store sufficient energy to be able to provide power for as long as any "0" level can be present on microphone line 7.

It would be very desirable to provide a single integrated circuit chip that is capable of being used for communication between a host circuit and an accessory circuit in either the MSFT mode or the digital communication mode.

Thus, there is an unmet need for a versatile, inexpensive integrated circuit to provide communication between a host circuit such as a smart phone and an accessory circuit such as an associated headset.

There also is an unmet need for a single integrated circuit chip that is capable of being used for communication between a host circuit and an accessory circuit in either MSFT mode or digital communication mode.

SUMMARY OF THE INVENTION

It is an object of the invention to provide a versatile, inexpensive integrated circuit to provide communication between a host circuit such as a smart phone and an accessory circuit such as an associated headset.

It is another object of the invention to provide a single integrated circuit chip that is capable of being used for communication between a host circuit and an accessory circuit in either MSFT mode or digital communication mode.

Briefly described, and in accordance with one embodiment, the present invention provides an audio accessory key detection system (40) which includes a host circuit (2-3) coupled to communicate via a microphone line (7) with an accessory circuit (3-3) in either a MSFT mode or a digital communication mode. Depletion mode transistors (44-1,2,3) in the accessory circuit are coupled between keys (15-1,2,3) of the accessory circuit, respectively. The depletion mode transistors are allowed to remain conductive for MSFT mode operation. For digital communications mode operation, the host circuit sends a command via the microphone line to a key detector and controller circuit (29A) in the accessory circuit. In response, a voltage is generated to turn the depletion mode transistors off so as to allow digital communications mode operation between the accessory circuit and the host circuit.

In one embodiment, the invention provides an audio accessory key detection system (40) including a host circuit (2-3) including: a host controller (11) and a bias circuit (5) coupled by a first resistor (R1) to a microphone line (7); a host transceiver (21) in the host circuit (2-3) coupled to the microphone line (7) and the host controller (11); an analog to digital converter (9) in the host circuit (2-3) for digitizing an analog signal level on the microphone line (7) and conveying a digital representation of the analog signal level to the host controller (11) during a MSFT mode of operation; and an accessory circuit (3-3) including: a microphone (13A) and a microphone bias circuit (13B) each coupled to the microphone line (7), a plurality of keys (15-1, 2, 3, . . . N) that may be actuated by a user to control a corresponding function to be performed by the host circuit (2-3), a key detector and controller circuit (29A) coupled to the keys (15-1, 2, 3, . . . N), and an energy storage circuit (28, CSTORAGE) coupled to the microphone line (7) coupled to deliver a supply voltage (VDD) to the key detection and controller circuit (29A); an accessory transceiver (31) in the accessory circuit (3-3) coupled to the microphone line (7) and to the key detection and controller circuit (29A); and a plurality of depletion mode transistors (44-1, 44-2, 44-3) each having a source coupled to the microphone line (7), a drain coupled to a terminal of a corresponding key (15-1, 2, 3, . . . N), and a gate controlled so as to allow the depletion mode transistors (44-1, 44-2, 44-3) to remain in a conductive condition during the MSFT mode of operation and to cause the depletion mode transistors (44-1, 44-2, 44-3) to be in a non-conductive condition during a digital communication mode of operation.

In a described embodiment, a charge pump (50) is coupled to the supply voltage (VDD), the charge pump (50) having an output (45) coupled to the gates of the depletion mode transistors (44-1, 44-2, 44-3) and operating to turn the depletion mode transistors (44-1, 44-2, 44-3) off during the digital communication mode of operation. The host circuit (2-3) may be included in a smart phone and the accessory circuit (3-3) may be included in a headset coupled to the smart phone by means of the microphone line (7).

In one embodiment, the host transceiver (21) includes a transistor (25) having a source coupled to ground, a gate coupled by a data conductor (26) to the host controller (11), and a drain coupled to the microphone line (7). The host transceiver (2) also includes a buffer (22) having an input coupled to the microphone line (7) and an output coupled by a data conductor (23) to the host controller (11). The accessory transceiver (31) includes a transistor (35) having a source coupled to a reference voltage (GND), a gate coupled by a data conductor (36) to the key detector and controller circuit (29), and a drain coupled to the microphone line (7). The accessory transceiver (31) also includes a buffer (32) having an input coupled to the microphone line (7) and an output coupled by a data conductor (33) to the key detector and controller circuit (29A).

In a described embodiment, the depletion mode transistors (44-1, 44-2, 44-3) are P-channel depletion mode MOS transistors. The depletion mode transistors (44-1, 44-2, 44-3) continuously couple the corresponding keys (15-1,15-2, 15-3) to the microphone line (7) during the MSFT mode.

In a described embodiment, the energy storage circuit (28) includes a storage capacitor ($C_{STORAGE}$) coupled between the microphone line (7) and a reference voltage (GND), wherein the storage capacitor ($C_{STORAGE}$) is sufficiently charged by the microphone line bias circuit (5) and various logical "1"s generated on the microphone line (7) during the digital communication mode to always store enough charge to cause the charge pump (50) to keep the depletion mode transistors (44-1,44-2,44-3) always turned off during the digital communication mode.

In one embodiment, the host controller (11) sends a command to the accessory controller (29C) via the host transceiver (21), microphone line (7), and accessory transceiver (31) to cause the accessory controller (29C) to enable the charge pump (50) so as to cause the depletion mode transistors (44-1,44-2,44-3) to go into their nonconductive condition if the digital communication mode operation is desired. The command to the accessory controller (29C) allows the accessory controller (29C) to disable the charge pump (50) so as to cause the depletion mode transistors (44-1,44-2,44-3) remain in their conductive condition if the MSFT mode operation is desired.

In a described embodiment, the key detector and controller circuit (29A) includes an accessory controller (29C) coupled to the accessory transceiver (31) and to an enable input (51) of the charge pump (50) and also includes a key detector circuit (29B) coupled between the plurality of keys (15-1,2,3, . . . N) and the accessory controller (31).

In one embodiment, the invention provides a method for detecting key actuation in an audio accessory key detection system (40) including a host circuit (2-3) including a host controller (11), a host transceiver (21) coupled to a microphone line (7) and to the host controller (11), and a bias circuit (5) coupled by a resistor (R1) to the microphone line (7), and an accessory circuit (3-3) including a plurality of keys (15-1,2,3, . . . N) that each may be actuated by a user to control a corresponding function to be performed by the host circuit (2-3), a key detector and controller circuit (29A) coupled to the keys (15-1,2,3, . . . N), an energy storage circuit ($C_{STORAGE}$) coupled to the microphone line (7) and also coupled to deliver a supply voltage (VDD) to the key detection and controller circuit (29A), and an accessory transceiver (31) coupled to the microphone line (7) and to the key detection and controller circuit (29A), the method including providing at least one mode selection transistor (e.g., 44-1) coupled between the microphone line (7) and a first terminal (e.g., 41-1) of a first key (e.g., Key 1), the mode selection transistor (e.g., 44-1) being a depletion mode transistor that is conductive unless a relatively large magnitude voltage level is applied to a gate electrode thereof; for MSFT mode operation, the method includes applying a relatively low magnitude voltage level to the gate electrode of the first mode selection transistor to cause it to be conductive, causing a predetermined voltage level to be produced on the microphone line (7) in response to activation of the first key (Key 1), digitizing the predetermined voltage level, and operating the host controller (11) in response to the predetermined voltage level to perform a first function corresponding to the first key (Key 1); and for digital communications mode operation, the method includes applying a relatively high magnitude voltage level to the gate electrode of the mode selection transistor to cause it to be non-conductive, operating the key detector and controller circuit (29A) and the accessory transceiver (31) to generate first digital data on the microphone line (7) in response to actuation of one of the keys (15-1,2,3, . . . N) and conveying the first digital data to the host controller (11) by means of the host transceiver (21), and operating the host controller (11) in response to the first digital data to perform a first function corresponding to the one of the keys (15-1, 2,3, . . . N).

In one embodiment, the method includes providing three mode selection transistors (44-1, 44-2, 44-3) coupled between the microphone line (7) and first terminals (41-1, 41-2, 41-3), respectively, of three of the keys (Key 1, Key 2, Key 3). In one embodiment, the method includes providing P-channel depletion mode MOS (metal oxide semiconductor) transistors as the mode selection transistors.

In one embodiment, the method includes applying the relatively high magnitude voltage level to the gate electrode of the mode selection transistor by means of a charge pump (50) controlled by the key detector and controller circuit (29A). In one embodiment, the method includes causing the host controller (2) to send a command to the accessory controller (29C) via the host transceiver (21), microphone line (7), and accessory transceiver (31) to cause the accessory controller (29C) to enable the charge pump (50) so as to cause the depletion mode transistors (44-1,44-2,44-3) to go into their nonconductive condition if the digital communication mode operation is desired.

In one embodiment, the invention provides a system for detecting key actuation in an audio accessory key detection system (40) including a host circuit (2-3) including a host controller (11), a host transceiver (21) coupled to a microphone line (7) and to the host controller (11), and a bias circuit (5) coupled by a resistor (R1) to the microphone line (7); the system also includes an accessory circuit (3-3) including a plurality of keys (15-1, 2, 3, . . . N) that each may be actuated by a user to control a corresponding function to be performed by the host circuit (2-3), a key detector and controller circuit (29A) coupled to the keys (15-1, 2, 3, . . . N), an energy storage circuit ($C_{STORAGE}$) coupled to the microphone line (7) coupled to deliver a supply voltage (VDD) to the key detection and controller circuit (29A), and an accessory transceiver (31) coupled to the microphone line (7) and to the key detection and controller circuit (29A). At least one mode selection transistor (e.g., 44-1, 2, or 3) is coupled between the microphone line (7) and a first terminal (e.g., 41-1) of a first key (e.g., Key 1), the mode selection transistor (e.g., 44-1) being a depletion mode transistor that is conductive unless a relatively large voltage level is applied a gate electrode thereof; for MSFT mode operation; the key detection and controller circuit includes means (50,29A) for applying a relatively low voltage level to the gate electrode of the first mode selection transistor to cause it to be conductive; the accessory circuit (3-3) includes means (GND,R2,R3) for causing a predetermined voltage level to be produced on the microphone line (7) in response to activation of the first key (Key 1); the host circuit (2-3) includes means (9) for digitizing the predetermined voltage level, and means (9,10) for operating the host controller (11) in response to the predetermined voltage level to perform a first function corresponding to the first key (Key 1). For digital communications mode operation, the accessory circuit (3-3) includes means (50,29A) for applying a relatively high voltage level to the gate electrode of the mode selection transistor to cause it to be non-conductive, means (31) for operating the key detector and controller circuit (29A) and the accessory transceiver (31) to generate first digital data on the microphone line (7) in response to actuation of one of the keys (15-1, 2, 3, . . . N) and for conveying the first digital data to the host controller (11) by means of the host transceiver (21); the host circuit (3-2) includes means (11) for operating the host controller (11) in response to the first digital data to perform a first function corresponding to the one of the keys (15-1, 2, 3, . . . N).

DETAILED DESCRIPTION OF THE PREFERRED EMBODIMENTS

Figure 2:
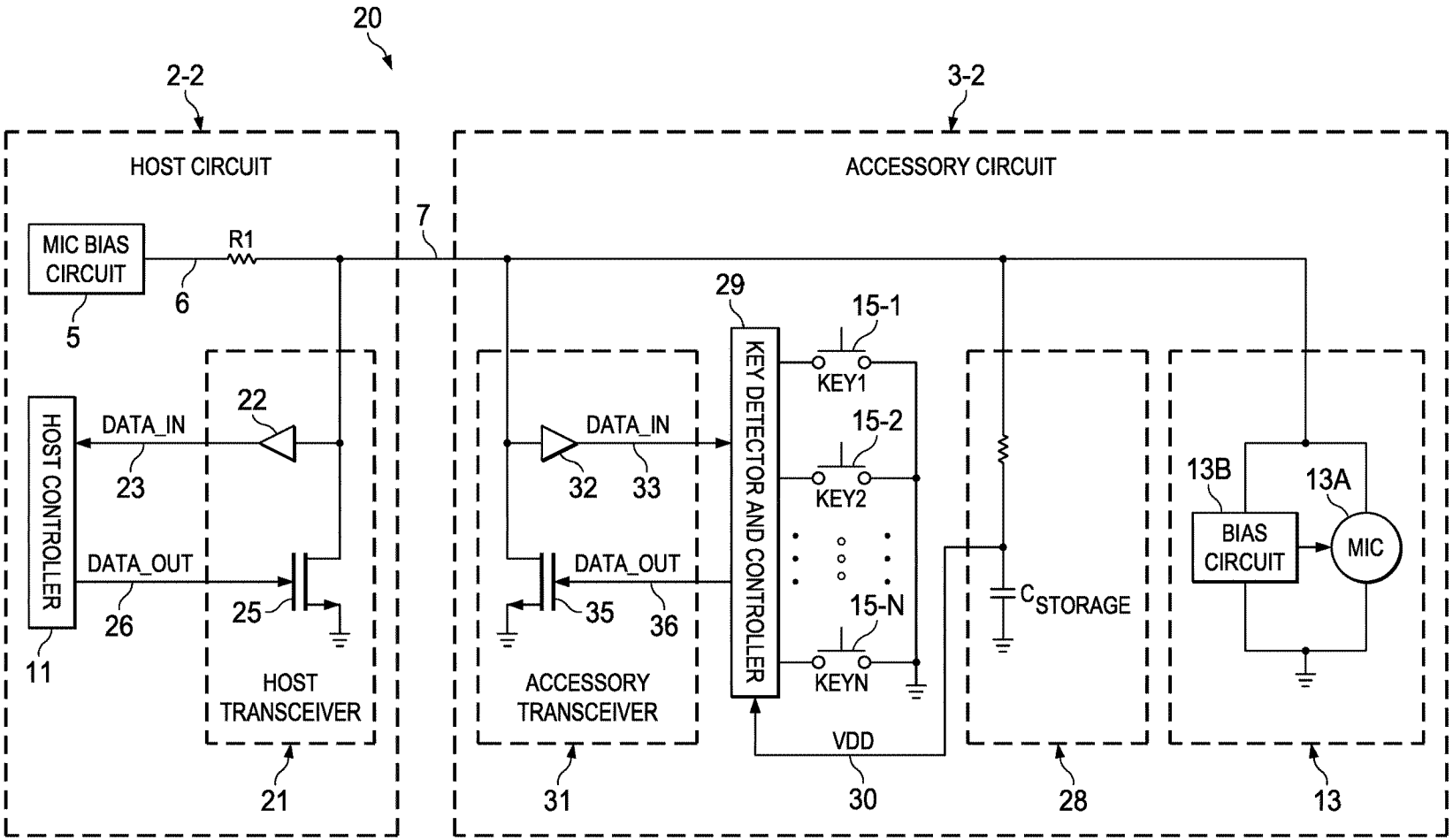
FIG. 2 (PRIOR ART)
FIG. 2 is a block diagram illustrating a known host and accessory system which provides only conventional digital communication between the host and the accessory.
Figure 3:
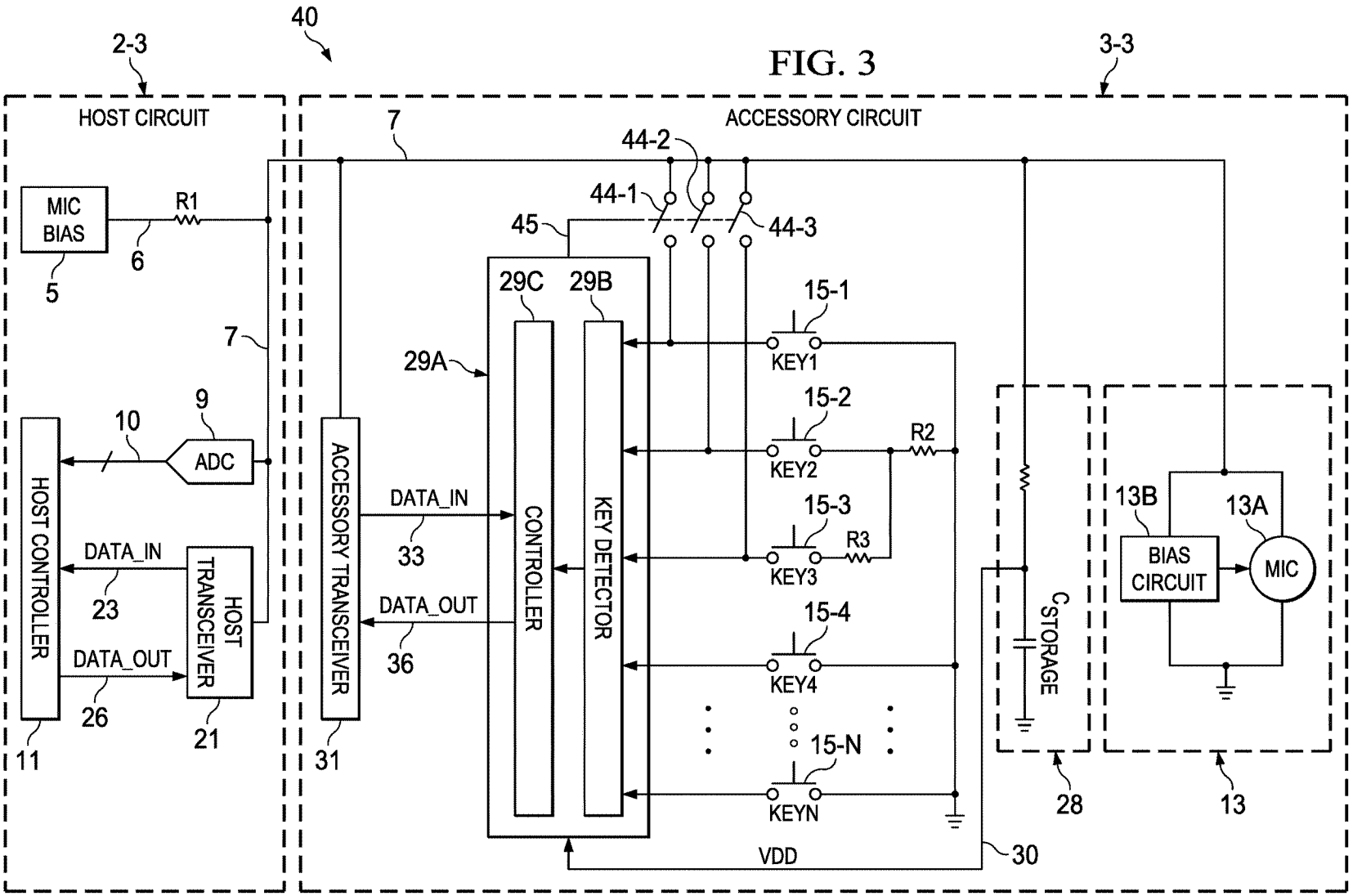
FIG. 3 is a block diagram of a host and accessory system which can provide either conventional MSFT communication or digital communication between the host and the accessory.

In FIG. 3, audio accessory key detection system 40 is capable of operating in either the MSFT mode or the digital communications mode (which also is sometimes referred to as the "1-wire mode"). System 40 includes a host circuit 2-3 that includes a microphone bias circuit 5 coupled by a conductor 6 and resistor R1 (which may have a resistance of approximately 2 kilohms) to a microphone line 7. Host circuit 2-3 may, for example, be included in a smart phone. Host circuit 2-3 also includes a host transceiver 21 having its input coupled to microphone line 7 and its output coupled by digital DATA_OUT bus 26 to an output of host controller 11. A DATA_IN bus 23 is coupled between the serial data output of host transceiver 21 and a data input of host controller 11. Host transceiver 21 may be implemented in various ways, for example by means of an open-drain of transistor 25 and buffer 22 as shown in Prior Art FIG. 2. Host circuit 2-3 also includes an ADC (analog to digital converter) 9 having its input coupled to microphone line/conductor 7 and its output coupled by digital bus 10 (which may be either a serial or a parallel bus) to a host controller 11.

Figure 1:
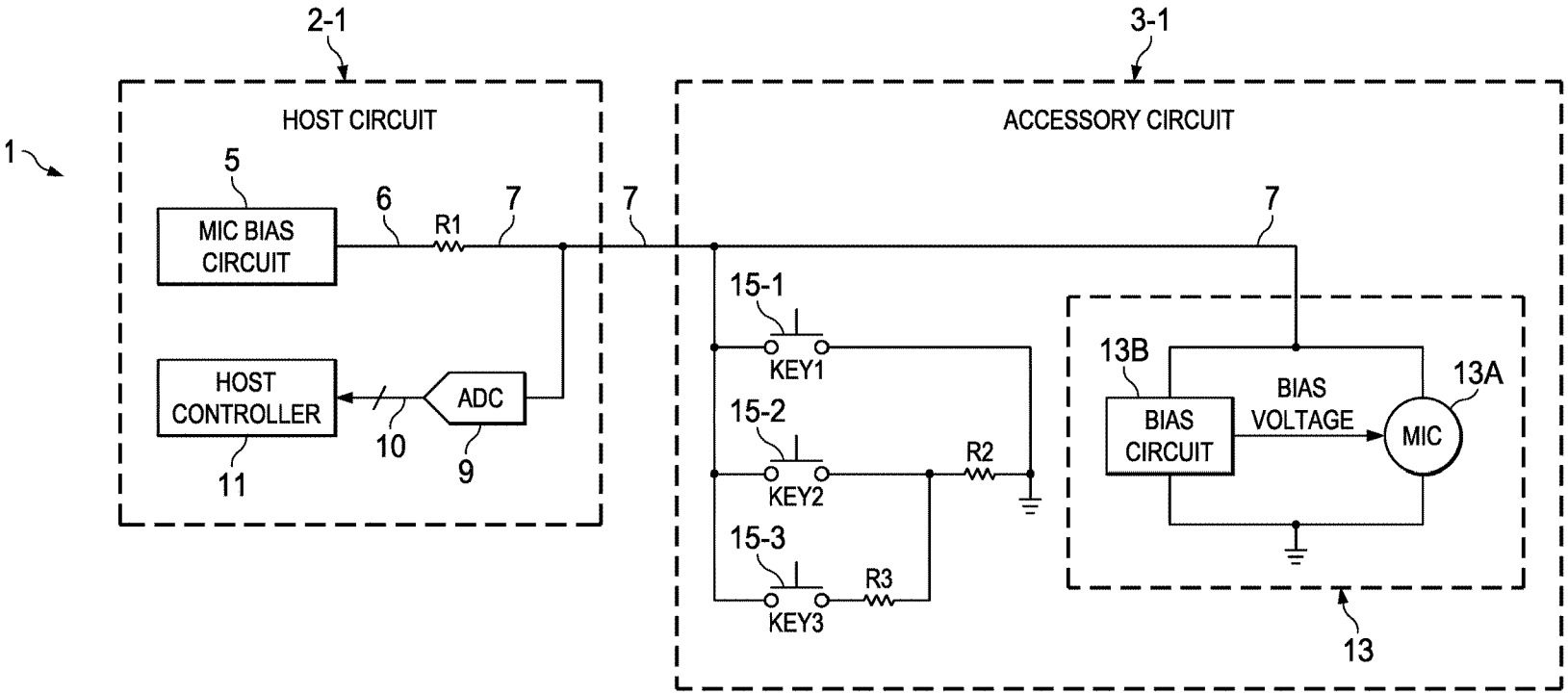
FIG. 1 (PRIOR ART)
FIG. 1 is a block diagram illustrating a conventional audio accessory key detection system which provides only conventional analog MSFT communication between the host and the accessory.

Audio accessory key detection system 40 also includes an accessory circuit 3-3 including microphone and bias circuitry 13 and also including N pushbutton keys or switches 15-1, 15-2, 15-3, and 15-4, . . . 15-N (which are also labeled "Key 1", "Key 2", etc). In MSFT mode, Key 1, Key 2, and Key 3 are utilized the same as indicated in Prior Art FIG. 1. Microphone and bias circuitry 13 includes a microphone 13A and a bias circuit 13B each connected to microphone line 7. The N switches 15-1, 15-2, . . . ,15-N are manual switches or buttons of the accessory, which may be a headset that contains accessory circuit 3-3. A first terminal of each of switches 15-1, 15-2, . . . 15-N is coupled to a key detection and controller circuit 29A by means of conductors 41-1, 41-2, . . . 41-N, respectively.

The second terminal of switch 15-1 is connected to ground. The second terminal of switch 15-2 is coupled to ground by a resistor R2 (which may be 220 ohms). The second terminal of switch 15-3 is coupled by a resistor R3 (which may be 390 ohms) to the second terminal of switch 15-2. The second terminals of the remaining switches 15-4, 15-5, . . . 15-N are all connected to ground. A key detector and controller circuit 29A is powered by a signal VDD generated by energy storage circuit 28, which may include a storage capacitor $C_{STORAGE}$ and a resistor coupled in series between microphone line 7 and ground (or other suitable reference voltage). VDD conductor 30 is connected to the junction between the resistor and one terminal of $C_{STORAGE}$, the other terminal of which is connected to ground. The resistor blocks current from flowing back to microphone line 7 when '0's are being transmitted (because microphone line 7 is pulled to ground when each '0' is transmitted). Alternatively, energy storage circuit 28 could include a rechargeable battery. Energy storage circuit 28 is coupled between microphone line 7 and a reference voltage such as ground.

Figure 4:
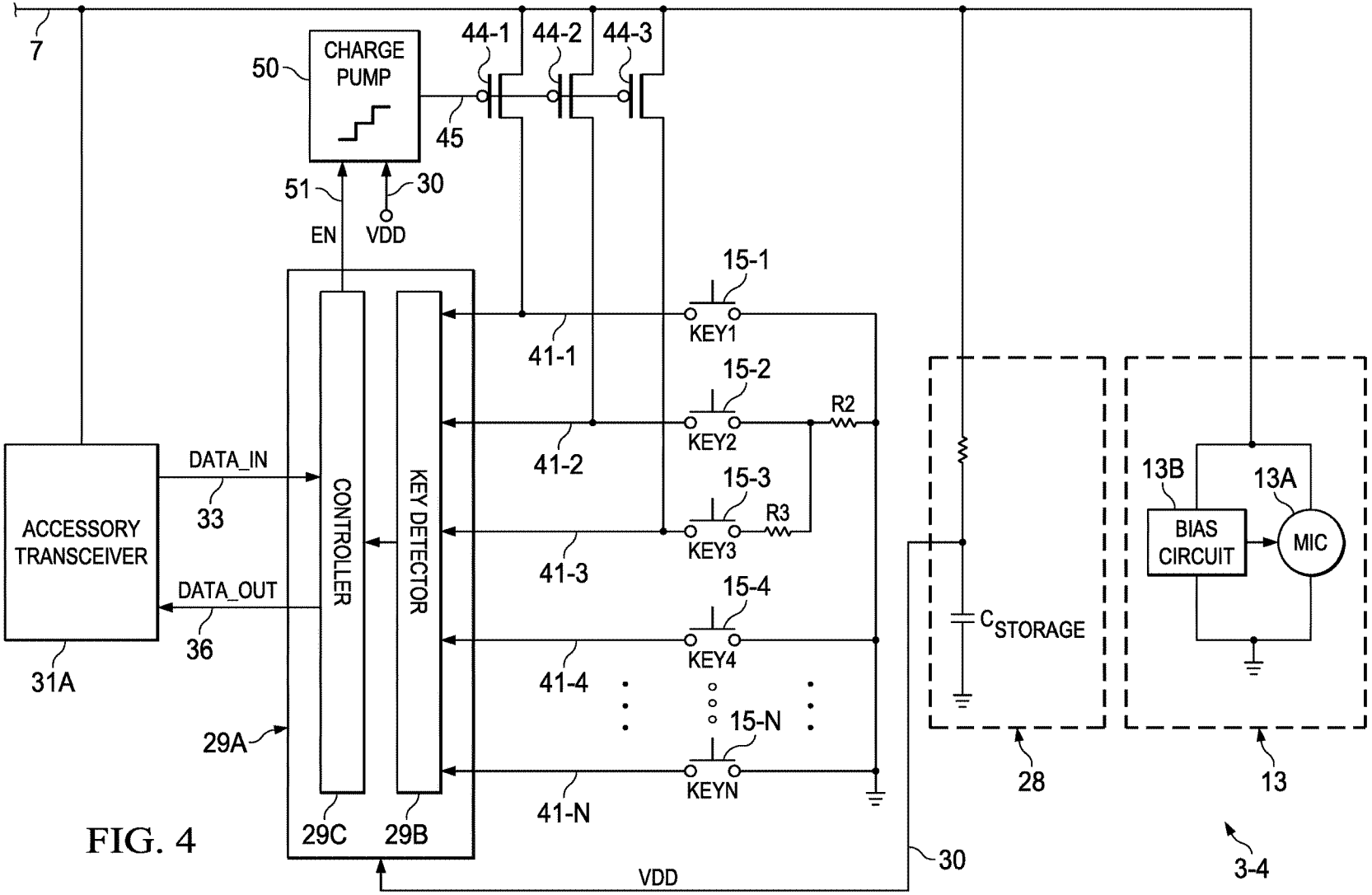
FIG. 4 is a block diagram illustrating an implementation of the circuitry shown in block 3-3 of FIG. 3.

Key detector and controller circuit 29A, which is shown in both FIGS. 3 and 4, includes a conventional key detector circuit 29B coupled to a conventional controller circuit 29C. Key detector circuit 29B and controller circuit 29C can be readily implemented in various ways. Controller circuit 29C is directly coupled by DATA_IN conductor 33 and DATA_OUT conductor 36 to accessory transceiver 31. Key detector circuit 29B and controller circuit 29C operate together to detect and decode the signal resulting from the pressing or actuating of any key of the accessory circuit 3-3 when it is operating in its digital communication mode, and then operates to transmit corresponding digital data to host circuit 2-3 via accessory transceiver 31 and microphone line 7. Key detector circuit 29B is used for digital communication mode, and is connected to one terminal of each of switches 15-1,2, . . . N. When any of the keys is depressed, key detector circuit 29B detects the depressing of the key and sends corresponding key information to accessory controller 29C. Accessory controller 29C sends corresponding key status information to accessory transceiver 31 by means of serial digital output signal DATA_OUT on serial bus 36, which is connected to a serial data input port 33 of accessory transceiver 31. Accessory controller 29C operates to monitor the key detection information received from key detector circuit 29B and sends corresponding key status information to host controller 11 by means of accessory transceiver 31, microphone line 7, and host transceiver 21. Accessory controller 29A also controls subsequently described charge pump 50 in FIG. 4 so as to enable charge pump 50 to turn the depletion mode P-channel MOS transistors 44-1, 44-2, and 44-3 off during digital communication mode operation. In MSFT mode, accessory controller 29C in effect disables charge pump 50 so as to allow the depletion mode transistors 44-1, 44-2, and 44-3 to remain closed.

It should be understood that are many ways for various host devices that may contain host circuit 2-3 and various accessory devices that may contain accessory circuit 3-3 to communicate in accordance with either the digital communication mode or the MSFT mode, and that purchasers of integrated circuits which include host circuit 2-3 and/or accessory circuit 3-3 provide some circuitry and/or software needed to accomplish the communication in either mode. At the beginning of operation, host circuit 2-3 takes control of accessory circuit 3-3 in the headset (or other accessory). If host circuit 2-3 supports the digital communication mode, it sends an initial command to accessory circuit 3-3 via host transceiver 21, microphone line 7, and accessory transceiver 31. Accessory controller 29C receives that initial command, decodes it, and causes charge pump 50 (FIG. 4) to open (i.e., turn off) depletion mode switch transistors 44-1, 44-2, and 44-3. Ordinary digital communication mode operation than occurs between accessory circuit 3-3 and host circuit 2-3.

If the host device containing host circuit 2-3 does not support the digital communication mode, there is no such initial command from host circuit 2-3 to accessory circuit 3-3. Therefore, enhancement mode transistor switches 44-1, 44-2, and 44-3 remain in their "default" closed (i.e., conductive) states, thereby allowing MSFT mode operation between Key 1, Key 2, and Key 3 and host circuit 2-3, via microphone line 7 and ADC 9.

Some smart phones support the digital communication mode, and some support only the MSFT mode. Some customers may buy an aftermarket headset to use with their smart phone. Use of host circuit 2-3 and accessory circuit 3-3 of audio accessory key detection system 40 of FIG. 3 in a smart phone and aftermarket headset allows the smart phone to automatically communicate with the aftermarket headset regardless of whether the headset is a digital communication mode device or a MSFT mode device. In normal operation, host circuit 2-3 simply sends out the above mentioned initial command sequence to accessory circuit 3-3. If accessory circuit 3-3 realizes it can operate in the digital communication mode, it then shifts into the digital communication mode by automatically opening the depletion mode transistor switches 44-1, 44-2, and 44-3 in response to the initial command. Accessory circuit 3-3 then informs host circuit 2-3 that accessory circuit 3-3 is set for digital communication mode operation. If the host device containing host circuit 2-3 only supports the MSFT mode, then when a headset is plugged in to a smart phone, no initial command is sent from host circuit 2-3, so accessory circuit 3-3 remains in its "default" MSFT mode.

Accessory transceiver 31 could be the same as accessory transceiver 31 of Prior Art FIG. 2. Note that the open-drain transistors 25 and 35 shown in Prior Art FIG. 2 function well for single-wire data transmission on microphone line 7, and make it convenient to implement the ability to switch operation between the MSFT mode and the digital communication mode.

Accessory circuit 3-3 also includes three mode selection switches 44-1, 44-2, and 44-3 coupled between microphone line 7 and conductors 41-1, 41-2, and 41-3, respectively. The control terminals of mode selection switches 44-1, 44-2, and 44-3 are all connected by conductor 45 to an output of key detector and controller circuit 29A.

If the three mode selection switches 44-1, 44-2, and 44-3 are closed, they connect the left terminals of Key 1, Key 2, and Key 3, respectively, directly to microphone line 7 in order to provide MSFT mode operation. Also, ADC 9 in host circuit 2-3 digitizes the three different analog voltage levels that can be generated on microphone line 7 by depressing any of Key 1, Key 2, and Key 3 and transmits the digitized results via digital bus 10 to host controller 11 in FIG. 3. Host controller 11 then uses the digitized "depressed key information" to determine which key has been depressed (or released) and accordingly causes a process or function corresponding to the depressed key to be performed. That is, in MSFT mode the ADC and host controller 11 function the same as in the circuit shown in Prior Art FIG. 1. Thus, if host circuit 2-3 can only support an "MSFT mode" accessory, mode selection switches 44-1, 44-2, and 44-3 must be kept closed. Or, if host circuit 2-3 can only support a "digital communication mode" accessory, mode selection switches 44-1, 44-2, and 44-3 must be kept open.

FIG. 4 is a block diagram illustrating an implementation 3-4 of accessory circuit 3-3 in FIG. 3, wherein mode selection switches 44-1, 44-2, and 44-3 are depletion mode P-channel MOS (metal oxide semiconductor) transistors. Accessory circuit 3-4 includes a charge pump circuit 50 that generates a control voltage on conductor 51, which is connected to the gates of depletion mode transistors 44-1, 44-2, and 44-3. (There are many ways of implementing a charge pump. See the reference "On-Chip High-Voltage Generation in MNOS Integrated Circuits Using an Improved Voltage Multiplier Technique" by John F Dickson, IEEE Journal of solid-state circuits, Vol. SC-11, No. 3, June 1976, pp. 374-378.) The 3 depletion mode P-channel transistors 44-1, 44-2, and 44-3 are normally in an "on" or conductive condition (wherein the source-to-drain channel resistance of the depletion mode transistor is at a minimum or low value) when no large-magnitude gate-to-source VGS turn-on voltage is applied to them. That is, when the VGS voltage of each depletion mode transistor is zero, it is in its "on" or conductive condition. When the magnitude of the VGS voltage of the depletion mode transistor is at a sufficiently high level, its source-to-drain channel resistance becomes extremely high and the depletion mode transistor is in its "off" or non-conductive condition.

When audio accessory key detection circuit 40 (FIG. 3) is operating in its MSFT mode, the 3 "additional" depletion mode transistors 44-1, 44-2, and 44-3 shown in FIG. 4 need to be "on", i.e., conductive, even when there is no voltage on the microphone line 7. For example, if Key 1 is depressed for a long period of time, the storage capacitor $C_{STORAGE}$ in energy storage circuit 28 will become discharged. That will cause VDD to be equal to zero until a sufficiently large voltage level appears on microphone line 7 to recharge $C_{STORAGE}$. As long as VDD is equal to zero, charge pump 50 cannot generate a "turn off" voltage to gates of depletion mode P-channel MOS transistors 44-1, 44-2, and 44-3. Therefore, depletion P-channel MOS transistors 44-1, 44-2, and 44-3 will be "on" or conductive between their source and drain electrodes. Otherwise, Key 1 being depressed can not hold microphone line 7 at ground voltage.

However, when audio accessory key detection circuit 40 of FIG. 3 is operating in its digital communication mode depletion mode, P-channel transistors 44-1, 44-2, and 44-3 must be in their "off" condition. Consequently, microphone line 7 must be "powered up", for example to 2 V (volts), because only then is charge pump 50 capable of charging conductor 51 to a voltage at a sufficiently large (for example, 2 V) to generate a sufficiently large VGS voltage on depletion mode P-channel transistors 44-1, 44-2, and 44-3 to keep them "off" or non-conductive. Since the depletion mode P-channel transistors are in their off or open condition, the normal voltage (e.g., 2 V generated on microphone line 7 by microphone bias circuit 5 of host circuit 2-3 of FIG. 3) will not be pulled to a lower value when any of keys 15-1, 15-2, M15-3 is depressed. Therefore, the value of VDD will always be high enough to adequately energize charge pump 50 so that it can always provide an adequate voltage on conductor 51 to keep depletion mode P-channel transistors 44-1, 44-2, and 44-3 in their open or non-conductive condition during the digital communication mode of operation.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, in some cases JFETs (junction field effect transistor) might be used as the depletion mode transistors.

What is claimed is:

1. A process of operating a headset that includes a microphone line, an accessory transceiver coupled to the microphone line, a key detector and controller circuit coupled to the accessory transceiver, pushbutton keys coupled to the key detector and controller circuit, and switches having control inputs coupled to the key detector and controller circuit and coupled between the pushbutton keys and the microphone line, the process comprising:

(a) operating the headset in an analog mode by closing the switches between the pushbutton keys and the microphone line in the absence of receiving a serial, digital signal in the key detector and controller circuit from the microphone line that indicates a digital communication mode; and (b) operating the headset in a digital communications mode by opening the switches between the pushbutton keys and the microphone line after receiving a serial, digital signal in the key detector and controller circuit from the microphone line that indicates a digital communication mode.

2. The process of claim 1 in which the switches include depletion mode transistor switches having control gates and the closing the switches includes removing voltage from the gates of the depletion mode transistor switches.

3. The process of claim 1 in which the switches include depletion mode transistor switches having control gates and the opening the switches includes applying voltage to the gates of the depletion mode transistor switches.

4. The process of claim 1 including controlling a charge pump to open the switches.

5. The process of claim 1 including operating a microphone coupled to the microphone line in an analog mode.

6. The process of claim 1 including sending a serial digital output signal on the microphone line from the key detector and controller circuit in the digital mode in response to actuating one of the pushbutton keys.

7. The process of claim 1 including sending a voltage level signal on the microphone line in an analog mode in response to actuating a pushbutton key.

8. The process of claim 1 including sending one of plural voltage level signals on the microphone line in an analog mode in response to actuating one of plural pushbutton keys.

9. The process of claim 1 including operating an integrated circuit coupled to the microphone line, the integrated circuit including the accessory transceiver coupled to the microphone line, the key detector and controller circuit coupled to the accessory transceiver, and the switches having control inputs coupled to the key detector and controller circuit and coupled between the pushbutton keys and the microphone line.

* * * * *